US005802422A

United States Patent [19]

Hokari

[11] Patent Number: 5,802,422

[45] Date of Patent: Sep. 1, 1998

[54] IMAGE FORMING DEVICE

[75] Inventor: Norio Hokari, Ebina, Japan

[73] Assignee: Fuji Xerox Co., Ltd., Tokyo, Japan

[21] Appl. No.: 887,230

[22] Filed: Jul. 2, 1997

[30] Foreign Application Priority Data

Jul. 5, 1996 [JP] Japan ..... 8-176476

[51] Int. Cl.[6] ..... G03L 15/16

[52] U.S. Cl. ..... 399/36; 399/301; 347/116

[58] Field of Search ..... 392/9, 36, 49, 392/299, 301; 347/115, 116

[56] References Cited

U.S. PATENT DOCUMENTS 4,965,637 10/1990 Katoh et al. ..... 399/36

5,444,525 8/1995 Takahashi et al. ..... 399/76

FOREIGN PATENT DOCUMENTS

U-63-188662 12/1988 Japan .

*Primary Examiner*—Joan H. Pendegrass

*Attorney, Agent, or Firm*—Oliff & Berridge, PLC

[57] ABSTRACT

An image forming device detects a standard pattern transferred to a transfer belt by an image carrier. The standard pattern is transferred onto the transfer belt at an image transfer position and detected at a standard pattern detection position. The distance between the image transfer position and the standard pattern detection position is a non-integer-multiple of the distance which the transfer belt is moved by one rotation of the image belt drive roll.

15 Claims, 3 Drawing Sheets

IMAGE FORMING DEVICE

BACKGROUND OF THE INVENTION

1. Field of Invention

The invention relates to an image forming device for color photocopying machines, color printers, and the like. In particular, the present invention relates to an image forming device which detects changes of speed of the transfer belt in order to arrange the position of the image.

2. Description of Related Art

As methods of a color image forming device, various methods are known, and one of them is called a tandem method. In a color image forming device using this tandem method, a plurality of image forming parts are located along the carrier path of the transfer material such as paper. In each image forming part, a toner image, each of which has a different color, is formed on the surface of a photosensitive body on a drum. Furthermore, the transfer material is carried by the transfer belt along a plurality of image forming parts. Then, in each image forming part, the toner image on the surface of the photosensitive body of each image forming part is repeatedly transferred at the same position of the surface of the transfer material, and thus, multicolored images are formed.

In such a color image forming device, if the transfer position of the toner image in each color on the transfer material is displaced even slightly, the quality of the image significantly decreases due to the shear in color of the toner image. Therefore, the position of the toner image of each color on the surface of the transfer material needs to be accurately matched.

However, in reality, due to the discrepancies of the production process of each kind of part and of assembling parts, it is difficult to match accurately the position of the toner image of each color on the surface of the transfer material. For instance, the photosensitive body is not a perfect circle, but a distortion exists, although it is slight. Moreover, this distortion depends on each photosensitive body. Also, the axis of the photosensitive body is eccentric and, furthermore, the condition of this eccentricity depends on each photosensitive body. Because of this, the moving speed of the surface of the photosensitive body (the peripheral speed of the photosensitive body) complicatedly changes over time.

When the peripheral speed of the photosensitive body is faster than the determined value, the length of the image formed on the surface of the photosensitive body in the circumferential direction of the photosensitive body becomes longer than the standard value. By the same token, when the peripheral speed is slow, the length of the image becomes short.

On the other hand, due to the irregular rotations of the driving system of the transfer belt and the expansion and contraction of the transfer belt, the carrier speed of the transfer material complicatedly changes with time. With respect to the surface speed of the photosensitive body, as the carrier speed of the transfer material becomes fast, the image on the photosensitive body is transferred under the condition in which the image is expanded in the transferring direction of the transfer material.

As explained above, in the color image forming device, due to various reasons, there is a possibility that the position of the toner image in each color on the surface of the transport material is displaced and that shear in color also occurs.

Because of this, there have been various methods proposed in order to avoid shear in color in the color image forming device.

For instance, the publication of Japanese Laid-Open Utility Model 63-188662 discloses a technology for changing the speed of the photosensitive body by controlling the rotation of the photosensitive drive motor. The drive motor is controlled based on the output of a pattern detection sensor obtained by forming a striped pattern image on the photosensitive body, imprinting the transfer belt with this pattern image, and detecting, by the pattern detecting sensor, the pattern image on the transfer belt.

Furthermore, the same publication discloses that the distance between the arranged position of the pattern detecting sensor and the image forming part corresponding to this pattern detecting sensor can be numerically divided by the circumference length of the photosensitive body without any remainder, or is to be the common multiple between the circumference of the drive shaft of the transfer belt and of the circumference of the photosensitive body.

According to the same publication, with the image forming device, no phase difference occurs between the transfer position and the sensor testing position. Thus, it is possible to avoid the offset position by the speed fluctuations of the transfer belt or speed fluctuations in one cycle of the photosensitive body.

However, in the image forming device described in the above publication, there is a problem of periodic changes generated by the rolls that drive the belt, that is, a problem of being unable to read a periodic change component. In other words, as written in the above publication, in the case where the distance between the position of the pattern detection sensor and the image forming part corresponding to the pattern detection sensor is to be a multiple of the circumference of the drive shaft of the transfer belt, for instance, the speed of the transfer belt at the pattern detection sensor becomes the same as the carrier speed of the transfer belt when the speed detecting pattern is transferred to the surface of the transfer belt in the image forming part, even when a periodic change occurs in the carrier speed of the belt, due to the eccentricity of the belt driving roll. Therefore, the periodic change component, which is originated by the belt driving roll, cannot be detected.

Furthermore, the distance between the arranged position of the pattern detecting sensor and the image forming part corresponding to the pattern detection sensor needs to be a common multiple of the circumference of the drive shaft of the transfer belt and the circumference of the photosensitive body. Therefore, there is a problem in the image forming device being enlarged due to the fact that an extremely long distance was required between the arranged position of the pattern detection sensor and the image forming part corresponding to the pattern detection sensor. Also, the design of the device is limited because the arranged position of the pattern detection sensor and the transfer position of the image forming part are fixed.

SUMMARY OF THE INVENTION

Therefore, it is an object of the invention to provide an image forming device which is able to detect a periodic change of speed of the transfer member, such as the transfer belt, originated by the rotation driving mechanism, such as the belt driving roll, without an enlargement of the device.

The invention transfer to the transfer belt the standard pattern (which has a predetermined pitch) for measuring the position of an image formed on the surface of the image carrier. By detecting, by the pattern detection sensor, the standard pattern which is transferred to the surface of the transfer belt, the distance between the image transfer position from the image carrier on the transfer belt and the standard pattern detection position by the pattern detection sensor is a distance other than an integer-multiple of the length of the belt that advances by one rotation of the roll that drives the transfer belt.

Furthermore, the invention transfer to the imprint belt the standard pattern (which has a predetermined pitch) for measuring the position of an image formed on the surface of the image carrier. By detecting, by the pattern detection sensor, the standard pattern which is transferred to the surface of the transfer belt, in the image forming device to detect the speed fluctuations of the transfer belt, the distance between the image transfer position from the image carrier to the transfer material and the standard pattern detection position by the pattern detection sensor is a distance other than an integermultiple of the length of the transfer material which moves by one rotation of the decelerating device and drive source which drives the transfer material.

According to the invention, since the distance between the transfer position and the image position reading sensor has been made to be a distance other than the integer-multiple of the length of the transfer member which advances by one rotation of the rotation drive mechanism, it is possible to read with a high degree of sensitivity the periodical speed fluctuation component of the transfer member such as a transfer belt.

DETAILED DESCRIPTION OF PREFERRED EMBODIMENTS

The invention will be explained with reference to the figures.

Figure 1:
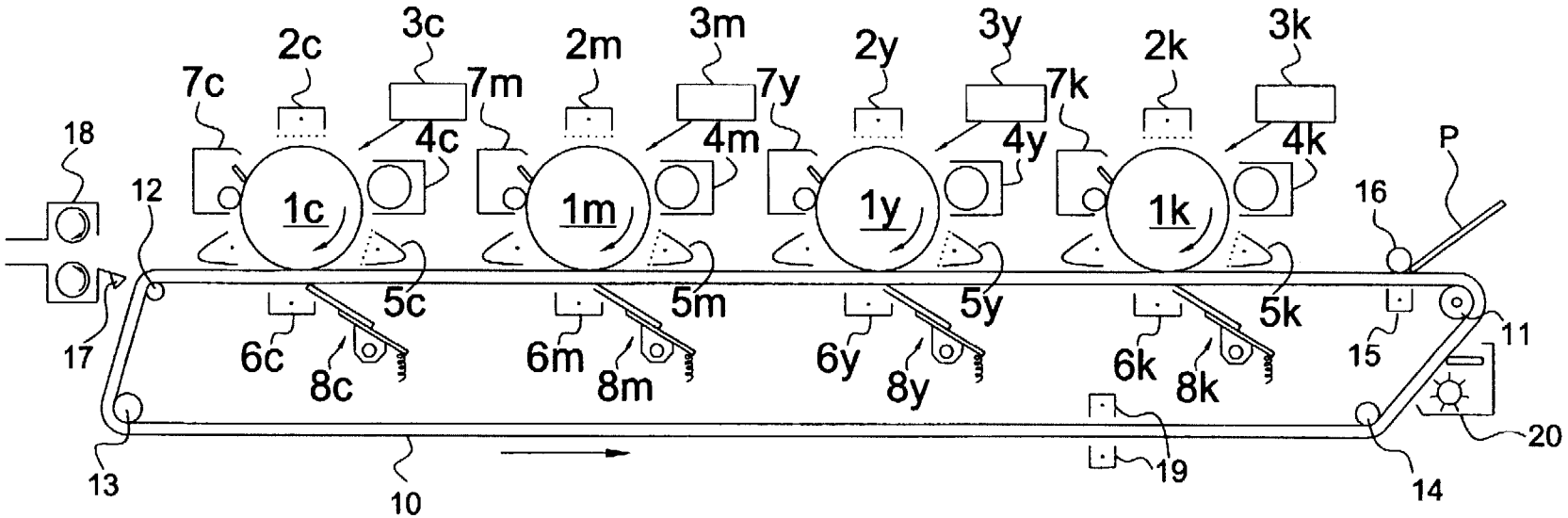
FIG. 1 is a schematic structural diagram showing the main part of the color image forming device to which this invention is applied.

FIG. 1 is a schematic structural diagram which shows the main part of the color image forming device to which the invention is applied.

The color image forming device shown in FIG. 1 is equipped with photosensitive body drums 1k, 1y, 1m, and 1c which act as image carriers which rotate in the direction of the respective arrows. Around these four photosensitive bodies 1k, 1y, 1m, and 1c, the same for each photosensitive body drum, are electric chargers 2k, 2y, 2m, and 2c, laser-scanning type image exposure devices 3k, 3y, 3m, and 3c, developing devices 4k, 4y, 4m, and 4c, pretransfer electric chargers 5k, 5y, 5m, and 5c, transfer devices 6k, 6y, 6m, and 6c, and cleaning devices 7k, 7y, 7m, and 7c. On the surface of each photosensitive body drum 1k, 1y, 1m, 1c, a monocolor toner image of each color k (black), y (yellow), m (magenta), and c (cyan) is separately formed.

For instance, in the case where the color image forming device is constituted as a digital color photocopy machine, an original set on an original board (which is not shown in the figure) is read by the color image reading machine, and the reading signal is converted to a digital image signal by an image signal process member and then it is temporarily stored to memory. Based upon the stored four colors (k, y, m, c) of the digital image signal, forming of the toner image of each color is performed. In other words, corresponding to the digital image signal of each color input from the image signal process means, the image exposure devices 3k, 3y, 3m, and 3c are separately driven to print a static latent image onto the photosensitive body drums, 1k, 1y, 1m, and 1c, which are evenly electrically charged by electric chargers 2k, 2y, 2m, and 2c respectively. Then, each of these static latent images is developed by a respective developing device, 4k, 4y, 4m, 4c, which contain the toner of each color (k, y, m, c), and the toner image of each of the above colors is formed. In addition, in the case where the color image forming device is constituted as a printer or the like, the toner image forming of each color is to be performed based upon the image signal input by the image signal process means from outside or the like.

Furthermore, in the color image forming device, the transfer belt 10 for carrying the transfer material comprises a seamless belt and is closely located such that it is in a non-contacting state under the above-listed four photosensitive body drums 1k, 1y, 1m, and 1c. This transfer belt 10 for carrying the transfer material is stretched and mounted onto the driving system roll 11, peel-off roll 12, tension roll 13, idler roll 14 and the like and it revolves in the direction of the arrow. Moreover, each of transfer baffles, 8k, 8y, 8m, and 8c, is arranged as a pushing means before each of the transfer devices 6k, 6y, 6m, 6c located opposite each photosensitive body drum 1 from the transfer belt 10 for carrying transfer materials, respectively. Furthermore, located around the transfer belt 10 for carrying transfer material, are an electric charger for attraction 15 and pressing roll 16 for pressing the transfer material P onto the transfer belt 10, a peel-off hook 17 to peel the transfer material P off from the surface of the transfer belt 10, a fixer 18 to fix an unfixed toner image on the surface of the transfer material P, an electric charge eliminator 19 to eliminate electric charges on the transfer belt 10, and a cleaning device 20 to eliminate toner adhesion on the surface of the transfer belt 10 and or the like. Furthermore, on the surface of the transfer belt 10 for carrying transfer material, a plurality of the transfer materials P can be attracted, held, in a respective holding area, and carried simultaneously.

As described above, a monocolor toner image of each color separately formed on each photosensitive body drum 1k, 1y, 1m, and 1c, is successively superimposed onto the transfer material P attracted to and carried by the transfer belt 10 after being controlled in the best electric-charged condition by the preimprint electric charger 5 depending upon current conditions. In other words, as a result of the transfer material P being carried by the transfer belt 10 and passing, in order, the transfer positions at which the transfer material P contacts each of the photosensitive drums 1k, 1y, 1m, and 1c, each toner image is superimposed. As the transfer procedure at the photosensitive drum 1c is completed, the transfer material P on which a multi-color toner image is formed is peeled off from the transfer belt 10 by the peel-off hook 17 and sent to the fixer 18. After the fixing procedure is completed, the transfer material P is sent out of the machine.

After each photosensitive drum, which completed the transfer procedure, is electrically eliminated after being cleaned by the cleaning device 7, the image forming process is continuously repeated, or the next image forming process is waited for. On the other hand, the transfer belt 10 from which the transfer material P has been peeled off is cleaned by the cleaning device 20 after being electrically discharged by the electric charge eliminator 19.

Figure 2B:
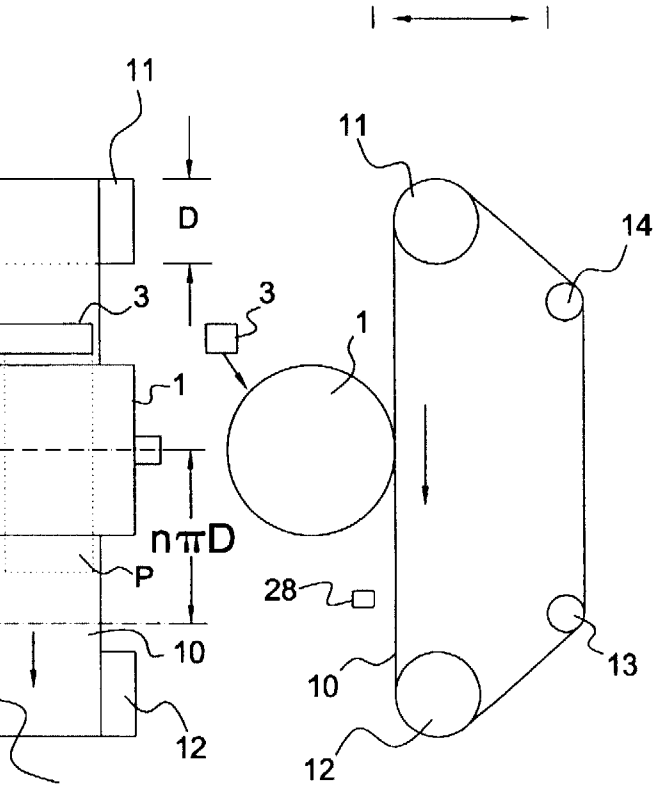
FIGS. 2A and 2B are schematic drawings which, in principle, show the rotation driving system of each photosensitive body drum in the color image forming device shown in FIG. 1.
Figure 2A:
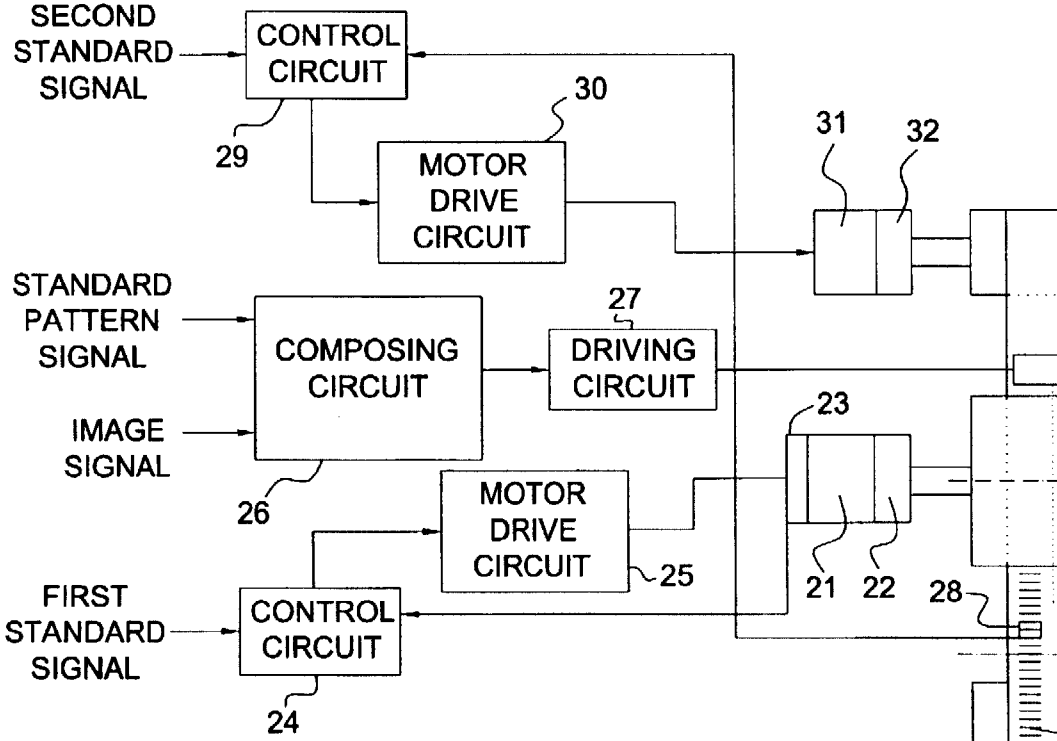

FIGS. 2A and 2B show in principle the rolling driving system of each of the photosensitive body drums, 1k, 1y, 1m, and 1c in the color image forming device described above. Since the rotation driving system of each of the photosensitive body drums 1k, 1y, 1m, and 1c has the same structure, they are explained commonly by generally calling them the photosensitive body drum 1.

To the photosensitive body drum 1, the drive motor 21 is connected through the decelerating device 22. The rotary encoder 23 is connected to the rotational axis of the drive motor 21 to detect the rotational speed of the drive motor 21. The output of rotary encoder 23 is compared with the first standard signal in the control circuit 24. The compared output is provided to the motor drive circuit 25 and then, the output of the motor drive circuit 25 is provided to the drive motor 21.

On the other hand, the image signal corresponding to the image which is to be formed on the transfer material P, and the standard pattern signal corresponding to the standard pattern which is to be formed on the transfer belt 10, are composed by the composing circuit 26. The output of the composing circuit 26 is provided to the image exposure devices 3k, 3y, 3m, and 3c (in FIG. 2, these are commonly indicated by the symbol 3) through the driving circuit 27. To simplify the following explanation, only the standard pattern signal is explained.

The above standard pattern signal, as shown in FIG. 2A, is a signal to form the stripe shaped standard pattern R which obtains the predetermined pitch in the carrier direction of the transfer belt 10, outside of the ordinary image formation area of the surface of the transfer belt 10. For each color, this standard pattern is formed in different positions in relation to the width direction of the transfer belt 10. The position of the standard pattern can be made differently by changing the occurrence timing of the standard pattern signal for each color. Moreover, in the FIG. 2A, only the standard pattern R corresponding to one color is shown.

Furthermore, on the side downstream of the photosensitive body drum 1 in relation to the carrier direction of the transfer belt 10, the pattern detection sensor 28 is located at a position corresponding to the standard pattern R of each color. This pattern detection sensor 28 is separately located, corresponding to each color. In this embodiment, the pattern detection sensor 28 is provided a distance from the image transfer position which is not an integer-multiple of the length of the transfer belt 10 which is advanced by one rotation of the roll 11 that drives the transfer belt 10. In the example shown in FIG. 2A, given the diameter of the roll 11 as D, the distance between the image transfer position and the pattern detection sensor 28 is provided at a position other than nnD. The significance of being provided at such position will be discussed later.

The output of the pattern detection sensor 28 is compared with the second standard signal in the control circuit 29, and the compared output is provided to the motor drive circuit 30, by which the rotational speed of the drive motor 31 which rotationally drives the roll 11 is controlled. The rotation of the drive motor 31 is transmitted to the axis of the driving roll 11, through the decelerating device 32.

Next, the actions to detect periodic changes in speed of the transfer belt 10, originated by the driving roll 11 in the color image forming device described above, are explained.

The output of the rotary encoder 23 in the drive motor 21 and the first standard signal are compared and the rotation of drive motor 21 is controlled such that the frequency and phase of the output of the rotary encoder 23 and the first signal are matched. Therefore, the photosensitive body drum 1 is rotated with the constant speed, which is determined by the frequency of the first standard signal.

At this time, because the standard pattern signal has been provided to the image exposure device 3, the static latent image corresponding to the standard pattern is formed on the photosensitive body drum 1 by the exposure of the image exposure device 3. This static latent image is developed by the developing devices, 4k, 4y, 4m, and 4c with the toner of each different color, and the standard pattern R of each color, having the stripe shaped pattern with the predetermined pitch in the moving direction of the transfer belt 10, is formed on the surface of the respective photosensitive body drum 1.

Next, the standard pattern R formed on the surface of the photosensitive body drum 1 is transferred to the surface of the transfer belt 10 where the transfer material does not go (outside paper-passage areas). The symbol R in FIG. 2A indicates the standard pattern transferred to the transfer belt 10. In the case where the moving speed of the transfer belt 10 is constant, the pitch of the standard pattern R transferred to the transfer belt 10 also becomes constant. However, in the case where there is eccentricity or contortion on the driving roll 11 that drives the transfer belt 10, the moving speed of the transfer belt 10 periodically fluctuates.

In other words, in an area where the distance between the center of rotation of the driving roll 11 and the part in which the surface of the driving roll 11 contacting the transfer belt 10 is long, the moving speed of the transfer belt 10 becomes fast, and in an area where the distance between the center of rotation of the driving roll 11 and the part in which the surface of the driving roll 11 contacting the transfer belt 10 is short, the moving speed of the transfer belt 10 becomes slow. Therefore, the pitch of the standard pattern R transferred to the transport belt 10 becomes large in the area where the moving speed of the transport belt 10 is fast, while it (the standard pattern R pitch transferred to the transfer belt 10) becomes narrow in the area where the moving speed of the transfer belt is slow.

The standard pattern R, which is transferred to the transfer belt 10, moves downstream of the carrier direction in accordance with the rotation of the transfer belt 10.

When the front end of the standard pattern R reaches the position of the pattern detection sensor 28, the standard pattern R is read by the pattern detection sensor 28 and the signal having a frequency corresponding to the pitch of the standard pattern R, is output. The signal from the pattern detection sensor 28 is compared to the second standard signal in the control circuit 29, and the rotation of the drive motor 31 is controlled such that the signal from the pattern detection sensor 28 and the second standard signal are matched.

In this embodiment, the distance between the image transfer position (opposing position between the transfer belt 10 and the photosensitive body drum 1) and the pattern detection position for measuring of the image position is arranged where it is not an integer-multiple of the length of the transfer belt 10 which moves by one rotation of the roll which drives the transfer belt 10.

By this, as explained below, the pattern detection sensor 28 can read the largest driving roll component among the speed changing component of the transfer belt 10, and thus the location of writing the pixel can be controlled with a high accuracy.

Preferably, the distance between the image transfer position and the pattern detection position is half of the amount of movement of the transfer belt 10 caused by one rotation of the driving roll 11 of the transfer belt 10. In this case, periodic changes generated by the roll driving the transfer belt 10 can be read twice as much. Furthermore, if the distance between the image transfer position and the pattern detection position is in the range of ¼–¾ the amount of movement of the transfer belt 10 caused by one rotation of the driving roll 11, it is acceptable because periodic changes can be measured more than once.

The meaning of setting the distance between the image transfer position and the pattern detection position as half of the amount of the movement of the transfer belt 10 caused by one rotation of the driving roll 11 of the transfer belt 10 will be explained below.

Given the belt speed Vb as:

$$Vb=VO+dV\times\cos(\omega t)$$

where VO is an average speed and dV is the amplitude of the speed fluctuation component.

The pixel distance L at which pixels are transferred to the surface of the transfer belt by a constant periodical interval T can be shown as follows:

$$\begin{aligned} L &= Vb\times T \\ &= \{VO+dV\times\cos(\omega t)\}\times T \end{aligned}$$

This implies that the pixel distance on the surface of the transfer belt shrinks or stretches.

Next, given the pixel distance/time (interval) information and the speed fluctuation component at the time of reading the image formed on the transfer belt with the pixel position reading sensor (pattern detection sensor 28), as TI and Vb', respectively, the pixel distance/time information TI can be described as follows:

$$\begin{aligned} TI=L/Vb' &= (Vb\times T)/Vb' \\ &= \{VO+dV\times\cos(\Omega t)\}\times T \quad (1) \\ &/ \{VO+dV\times\cos(\omega t+a)\} \end{aligned}$$

However, the value a is a phase difference determined by the distance d between the transfer position and the pixel location reading sensor and the distance Ldr which the transfer belt 10 moves by one rotation of the driving roll 11 which can be expressed by a=(d/Ldr)×2n.

However, as described in the earlier mentioned Publication of Japanese Laid-Open Utility Model 63-188662, if the value d is expressed as the integer-multiple of the value Ldr, an equation can be described as follows:

$$\cos(\omega t+n\times 2n)=\cos(\omega t).$$

However, n is a positive integer so that the value TI becomes equal to the value T. Moreover, a periodic speed fluctuation component, which originates to the driving roll, is eliminated and thus, it cannot be detected.

Here, in order to read the component of the driving roll 11, as paying attention to the change component of formula (1), the value cos(ωt) is a periodic function so that the greatest value of this periodic function is 1, and then, the pitch of the standard pattern R, which is transferred to the transfer belt 10, becomes the greatest.

Given ωt=2n, the value T can be written as follows:

$$TI=\{VO+dV\}\times T/\{VO+dV\times\cos(a)\},$$

When the value a is n, the denominator becomes smallest. In other words, the original transfer distance time information TI becomes the largest and the periodic speed fluctuation component, which is originated to the driving roll 11 with the largest amplitude can be detected. In order to satisfy this condition, because the value d/Ldr needs to be equal to 0.5, the distance d between the transfer position and the pixel reading sensor can be written as follows:

$$d=Ldr\times 0.5+nLdr$$

where n is a positive integer. This is the best measuring position.

Figure 3:
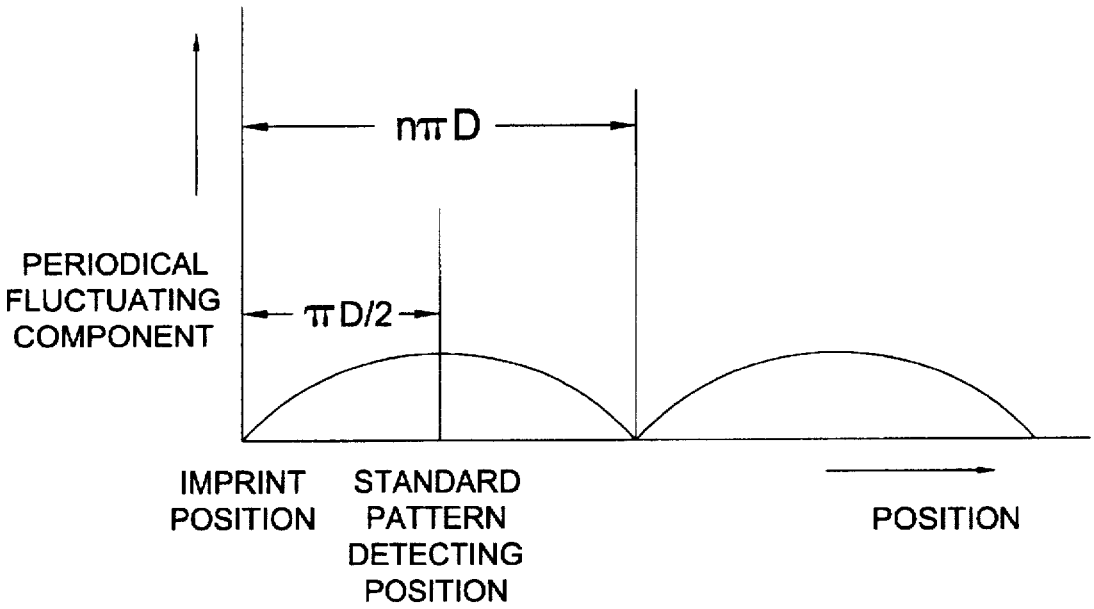
FIG. 3 is a graph showing the relationship of the distance between the transfer position and the measuring sensor for the original transfer position, and the size of the pixel distance time information.

FIG. 3 is a graph showing the relationship of the distance between the transfer position and the measuring sensor and the size of the pixel distance time information.

Furthermore, at each reading, the pattern detection sensor is preferably only able to read the stripe shaped pattern over a length equal to an integer-multiple of the length of the transfer belt 10 which moves by one rotation of the roll 11 driving the transfer belt 10. By doing this, the number of stripes of the standard pattern read at each reading becomes constant and scattering is not generated to the output of detection. By the same reason, the pitch in the standard pattern is preferably one over an integer-multiple of the length of the transfer belt 10 which moves by one rotation of the roll 11 which drives the transfer belt 10.

Furthermore, in the above written embodiment, the case of detecting the periodic speed change of the transfer belt 10 for carrying the paper, which is originated by the driving roll 11, was explained as an example. However, this invention is not limited to this point. For instance, the periodic speed change, which is originated by a primary factor other than the driving roll 11, such as the driving source and the decelerating device, can be detected. In this case, the distance between the image transfer position from the image carrier to the transfer member and the pattern detecting position of the pattern detecting sensor needs to be configured other than the integer-multiple of the length of said transfer member which moves by one rotation of the driving source and the decelerating device which drive the transfer member. Half of the distance of the transfer member which moves by one rotation of the driving source and the decelerating device driving the transfer member is more preferable, but it is also preferable that the distance falls within the range of the length of the transfer member which moves by ¼–¾ rotation of the driving source and the decelerating device that drive the transfer member.

Also, in this case, as the transfer member, a interim-transfer belt, a paper carrier transfer belt, a paper carrier transfer roll and the like can be used.

What is claimed is:

1. An image forming device, comprising:

a transfer belt having a surface and moving in a moving direction;

a drive roll for driving the transfer belt, the drive roll moving the transfer belt a first distance by one rotation of the drive roll;

an image carrier for transferring an image onto the surface of the transfer belt at an image transfer position; and a pattern detecting sensor for detecting a standard pattern transferred onto the transfer belt by the image carrier, the pattern detecting sensor detecting the standard pattern at a standard pattern detecting position, wherein a second distance between the image transfer position and the standard pattern detecting position is a non-integer-multiple of the first distance.

2. The image forming device claimed in claim 1, wherein the second distance is an odd-integer-multiple of a half of the first distance.

3. The image forming device claimed in claim 1, wherein the second distance is within the range of ¼–¾ times the first distance.

4. The image forming device claimed in claim 2, wherein the odd-integer-multiple is one.

5. The image forming device claimed in claim 1, wherein the standard pattern is formed of a striped pattern having a predetermined pitch in the moving direction of the transfer belt, and the pattern detecting sensor reads the striped pattern over a length equal to an integer-multiple of the first distance.

6. The image forming device claimed in claim 1, wherein the standard pattern is formed of a striped pattern having a predetermined pitch in the moving direction of the transfer belt, and the predetermined pitch is an inverse of an integer-multiple of the first distance.

7. An image forming device, comprising:

a transfer member having a surface and moving in a moving direction;

a drive source for moving the transfer member at a speed;

a speed altering device connected to the drive source for altering the speed at which the drive source moves the transfer member, the speed altering device moving the transfer member a first distance by one rotation of the speed altering device;

an image carrier having a surface and for transferring an image onto the surface of the transfer member at an image transfer position; and a pattern detecting sensor for detecting a standard pattern for image position measurement transferred onto the transfer member by the image carrier, the pattern detecting sensor detecting the standard pattern for image position measurement at a standard pattern detecting position, wherein a second distance between the image transfer position and the standard pattern detecting position is a non-integer-multiple of the first distance and the standard pattern for image position measurement has a predetermined pitch.

8. The image forming device claimed in claim 7, wherein the second distance is an odd-integer-multiple of a half of the first length.

9. The image forming device claimed in claim 7, wherein the second distance is within the range of ¼–¾ times the first distance.

10. The image forming device claimed in claim 8, wherein the odd integer multiple is one.

11. The image forming device claimed in claim 7, wherein the standard pattern is formed of a striped pattern having a predetermined pitch in the moving direction of the transfer member, and the pattern detecting sensor reads the striped pattern over a length equal to an integer-multiple of the first distance.

12. The image forming device claimed in claim 7, wherein the standard pattern is formed of a striped pattern having a predetermined pitch in the moving direction of the transfer member, and the predetermined pitch is an inverse of an integer-multiple of the first distance.

13. The image forming device claimed in claim 7, wherein the transfer member is an interim-transfer belt.

14. The image forming device claimed in claim 7, wherein the transfer member is a paper carrying transfer body.

15. The image forming device claimed in claim 14, wherein the paper carrying transfer body is a paper carrying transfer belt.

* * * * *